US005839837A

United States Patent [19]

Takehara

[11] Patent Number: 5,839,837

[45] Date of Patent: Nov. 24, 1998

[54] PRINTERS WHICH DISPLAY THE COLOR OF A PRINTING MEDIUM

[75] Inventor: Hiroki Takehara, Fussa, Japan

[73] Assignee: Casio Computer Co., Ltd., Tokyo, Japan

[21] Appl. No.: 727,975

[22] Filed: Oct. 9, 1996

[30] Foreign Application Priority Data

Oct. 13, 1995 [JP] Japan ..... 7-290547

[51] Int. Cl.[6] ..... B41J 11/00

[52] U.S. Cl. ..... 400/76; 400/83; 400/615.2; 400/586

[58] Field of Search ..... 400/615.2, 613, 400/83, 586, 76

[56] References Cited

U.S. PATENT DOCUMENTS

| | | | |
|---|---|---|---|
| 4,824,269 | 4/1989 | Havel . | |
| 5,210,547 | 5/1993 | Watanabe et al. | 400/611 |
| 5,480,246 | 1/1996 | Morimoto | 400/615.2 |
| 5,518,328 | 5/1996 | Okuchi et al. | 400/249 |
| 5,538,352 | 7/1996 | Sugiura | 400/615.2 |
| 5,620,268 | 4/1997 | Yamaguchi et al. | 400/613 |
| 5,673,372 | 9/1997 | Ishihara . | |

FOREIGN PATENT DOCUMENTS

| | | |
|---|---|---|
| 0 551 752 A2 | 7/1993 | European Pat. Off. . |
| 0 661 656 A2 | 7/1995 | European Pat. Off. . |
| 7-179013 | 7/1995 | Japan . |
| 7-181756 | 11/1995 | Japan . |
| 2 253 812 | 9/1992 | United Kingdom . |

OTHER PUBLICATIONS

Database WPI Section PQ, Week 9532, Derwent Publications Ltd., London, GB; Class P75, AN 95–243170 XP002059754 & JP 07–148918 A (Ricoh Co. Ltd.), 21 Jul. 1995—Abstract.

*Primary Examiner*—John S. Hilten
*Attorney, Agent, or Firm*—Frishauf, Holtz, Goodman, Langer & Chick

[57] ABSTRACT

A cartridge detector detects information on the color of a label tape of a cartridge which is a printing medium on the basis of the shape of the cartridge. A controller determines the color of the label tape on the basis of detected information obtained from the cartridge detector. The controller controls a display through a display control unit and displays the background of a display screen in the same color as that of the label tape determined on the basis of the detected information obtained from the cartridge detector. A key-in unit inputs to the printer printing data (for example, character, illustration data, etc.) and their print color data. The controller controls the display through the display control unit to display in the print color specified by the key-in unit the printing data input from the key-in unit in the screen background having the same color as the label tape. The input printing data is printed on the label tape by a printing unit through the print control unit.

6 Claims, 6 Drawing Sheets

PRINTERS WHICH DISPLAY THE COLOR OF A PRINTING MEDIUM

BACKGROUND OF THE INVENTION

1. Field of the Invention

The present invention relates to printers with a color display, and more particularly to a printer which is capable of easily confirming the color of a printing medium on a display screen and printing data in an appropriate combination of colors on the printing medium in accordance with its color.

2. Background Art

Conventionally, tape printers are known which print input printing data such as character, sign, and/or figure data on a tape, and cut the printed tape portion from the remaining tape to form a label.

In a conventional multi-color printable tape printer, a tape cartridge which contains a label tape and a multi-color printing ink tape is set in a cartridge accommodating space provided in the printer body, and a thermal head is driven to transfer ink in the ink tape to the label tape for printing purposes.

There are various colored label tapes prepared. A color indicator indicative of the color of the label tape contained in the tape cartridge is provided on the outer surface of the cartridge.

The user can select and use a label tape having a different color by exchanging a tape cartridge set in the cartridge accommodating space in the printer body.

The conventional tape printer is provided with a display which displays keyed-in printing data in a monochromatic manner.

However, in the conventional tape printer, the color of the label tape of a tape cartridge set in the tape printer will not be displayed, neither can print color of printing data, for example, of illustration and/or character data be determined and input in consideration of the color of the label tape on the display screen.

More specifically, the user looks into the cartridge accommodating space in the tape printer body provided next to the display through a window in a cover for the accommodating space to confirm a color indication of the label tape provided on the outer surface of the cartridge set in the accommodating space and specifies a print color of the printing data on the monochromatic display screen, using the key-in unit. Thus, the user cannot visually confirm the colors of the label tape and printing data in a contrasting manner.

SUMMARY OF THE INVENTION

It is therefore an object of the present invention to provide a printer in which the user is able to easily confirm the color of the printing medium on the display screen.

Another object of the present invention is to provide a printer capable of displaying printing data in an appropriate color to the color of the printing medium.

Still another object of the present invention is to provide a printer which is capable of easily performing colorful expressive printing.

In order to achieve the above objects, the present invention provides a printer comprising:

color display means;

color determining means for determining the color of a printing medium;

input means for inputting printing data;

display control means for displaying the background color of display by the color display means in the color determined by the color determining means and for displaying the printing data input from the input means in the background of display; and printing means for printing the printing data on the printing medium.

According to such arrangement, the background color of the color display screen is displayed in the color of the printing medium and the printing data is displayed in the background.

Thus, the user is able to easily recognize the color of the printing medium on the display screen and appropriately arrange illustrations and/or characters to be printed on the printing medium in consideration of the color of the printing medium.

Further, arrangement may be such that print color specifying means specifies the print color of the printing data, that the display control means displays on the color display means the printing data in the color specified by the print color specifying means, and that the printing means prints on the printing medium the printing data in the color specified by the print color specifying means.

According to such arrangement, the user can view the background color of the printing medium and the print color of the printing data in a contrasting manner on the color display screen, so that the user can appropriately arrange illustrations and/or characters to be printed on the printing medium in consideration of the color of the printing medium.

In this case, arrangement may be such that first color judging means judges whether the color determined by the color determining means coincides with the color specified by the print color specifying means, and that first message display control means is responsive to the first judging means judging that the color determined by the color determining means coincides with the color specified by the print color specifying means for displaying a predetermined message on the color display means.

According to such arrangement, an undesirable matter is avoided in which the same color as that of the printing medium would otherwise be specified as that of the printing medium or as any color of the same color system that the color of the printing medium belongs to, thereby rendering the printing data difficult to view.

Arrangement may be such that color information storage means is provided which contains a plurality of sets of different color information in a predetermined relationship;

print color setting means is provided for automatically setting a color in a predetermined relationship to the color determined by the color determining means as the print color of the printing data input by the input means on the basis of the color information contained in the color information storage means; and the printing means prints on the printing medium the printing data in the color set by the print color setting means.

According to such arrangement, the color of the printing data is automatically set relative to the color of the printing medium, so that specification of the print color of the printing data is omitted to simplify the operation, no mistakes occur in specifying the print color, and colorful expressive printing is achieved easily.

Arrangement may be such that a cartridge has a shape varying depending on the color of its printing medium, that detection means detects the shape of the cartridge, and that determining means determines the color of the printing medium contained in the cartridge on the basis of information indicative of the detected shape of the cartridge obtained from the detection means.

According to such arrangement, the structure of the color determining means for the printing medium in the tape cartridge is simplified.

Arrangement may be such that when a power supply for the printer is turned on, the display control means displays the color of the whole display screen of the color display means in the color determined by the color determining means. In that case, power supply control means may interrupt the supply of power to the printer when the opening of the cover is detected by the detection means.

According to such arrangement, when the power supply for the printer is turned on, the color of the printing medium can be immediately confirmed on the display screen, conveniently. Even when a tape cartridge containing a differently colored printing medium is exchanged by opening/closing the cover for the cartridge accommodating space, the color of the printing medium can be confirmed on the display screen immediately when the power supply is turned on.

BRIEF DESCRIPTION OF THE DRAWINGS

FIG. 5 is a flow chart indicative of a printing process started up when a power supply is turned on;

DESCRIPTION OF THE PREFERRED EMBODIMENTS

A printer as an embodiment of the present invention will be described, using as an example a tape printer which prints any characters, symbols, etc., on a tape-like printing medium, with reference to the accompanying drawings.

Figure 1:
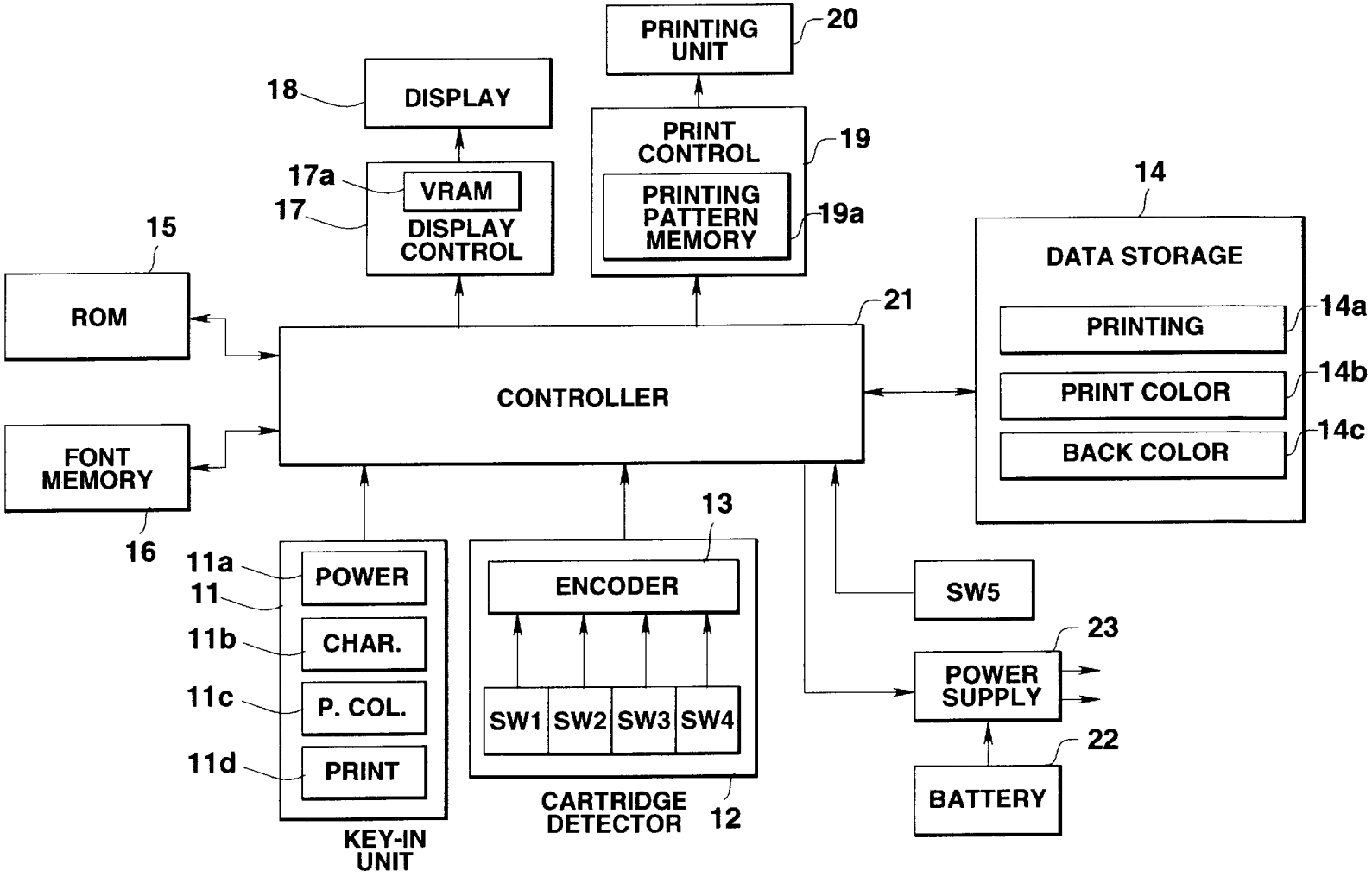
FIG. 1 is a block diagram of an electronic circuit of a printer according to the present invention.

FIG. 1 is a block diagram of an electronic circuit of the tape printer, which includes a key-in unit 11, a cartridge detector 12, a data storage 14, a ROM 15, a font memory 16, a display control unit 17, a display 18, a print control unit 19, a printing unit 20 and a controller 21.

The key-in unit 11 includes a power supply key 11*a*, character keys 11*b*, print color specifying keys 11*c*, a print key 11*d* for inputting printing data, commands, etc.

The power supply key 11*a* is operated to start/stop the supply of power to the printer. The character keys 11*b* include alphabetical keys, numeral keys, illustration keys, symbol keys and are operated to input printing data, for example, character, illustration, symbol, and/or numeral data. The print color specifying keys 11*c* are each operated to specify a print color of the printing data. The print key 11*d* is operated to command the printing unit 20 to start printing.

The cartridge detector 12 detects the presence/absence of a tape cartridge in the printer and generates information to determine the kind of the tape cartridge, if any, to the controller 21. The cartridge detector 12 is composed of a plurality of switches (in this case, four switches SW1–SW4) which generate detection signals indicating the presence/absence of a tape cartridge and its kind, an encoder 13 which encodes the detection signals from the switches SW1–SW4 and outputs the resulting signal to the controller 21.

Figure 2:
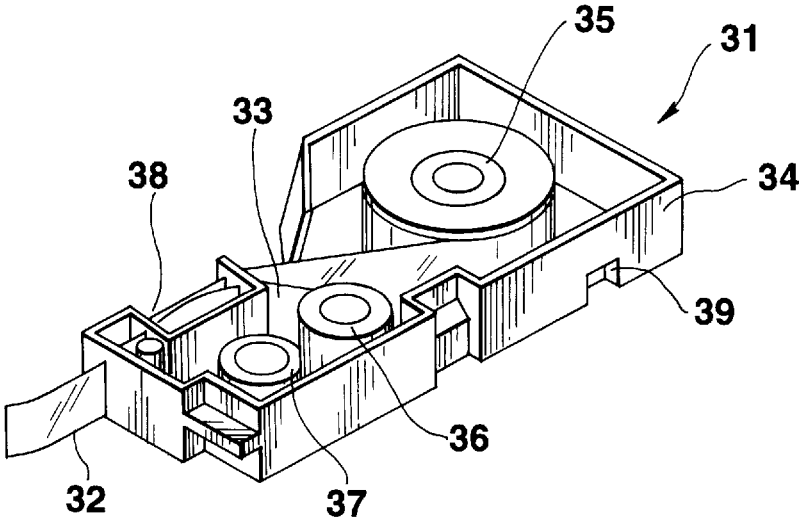
FIG. 2 shows the internal structure of a tape cartridge set in the printer.

As shown in FIG. 2, the tape cartridge 31 contains a label tape 32 as a printing medium and an ink tape 33. When a thermal head (not shown) of the printing unit 20 is driven to generate heat, the ink in the ink tape 33 is transferred to the label tape 32 for printing purposes. FIG. 2 shows the inside structure of the tape cartridge 31 with a transparent cover 43 (FIG. 4) which should be provided above a case 34 being removed away. Provided within the case 34 are a feed spool 35 for the label tape 32, a feed spool 36 for the ink tape 33 and a winding spool 37. A recess 38 is provided on the outside of the case 34 to dispose the thermal head therein. The label tape 32 and ink tape 33 are drawn into the recess 38 and pressed between the thermal head and a platen roller (not shown). A maximum number of three holes 39 is provided on the outer surface of the case 34 depending on the kind of the cartridge 31.

The label tape 32 has a peelable paper strip attached through an adhesive to the back thereof.

Eight different colors; white, orange, red, purple, black, blue, green, and yellow are prepared for the color of the label tape 32. Thus, eight different cartridges 31 containing corresponding different color label tapes are prepared.

Figure 3:
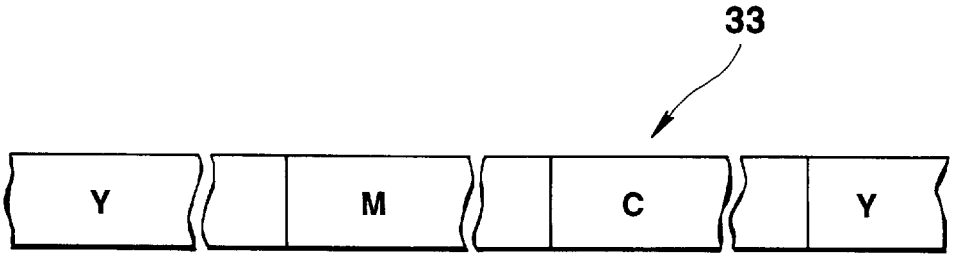
FIG. 3 shows the structure of an ink tape for color printing.

As shown in FIG. 3, the ink tape 33 has a plurality of different ink (Y (yellow), M (magenta) and C (cyan)) areas arranged repeatedly in this order for multi-colored printing.

The data storage 14 includes a printing data storage area 14*a* which stores as coded data printing data such as, for example, character, symbol, numeral and illustration data input by the key-in unit 11, a print color data storage area 14*b* which stores print color data indicative of the print color of the printing data, a background color data storage area 14*c* which stores data on the (background) color of the label tape 32 determined on the basis of the detection information from the cartridge detector 12, and an area (not shown) for storing other data set by the controller 21.

ROM 15 contains a program by which the controller 21, which may be composed of a microprocessor, controls the operation of the whole printer, and table data to be described later.

The font memory 16 contains font pattern data for characters, symbols, numerals and illustrations.

The display 18 is composed of a color liquid crystal display for display of a color image thereon.

The display control unit 17 includes a VRAM (display RAM) 17*a* which contains display pattern data, controls the drive voltage of display 18 in accordance with the control of the controller 21 to display printing data, etc., in a specified color in the background having the same color as the label tape 32.

The printing unit 20 has therein a cartridge accommodating space 41 (FIG. 4) in which a tape cartridge 31 is to be set, a printing mechanism (not shown) including a thermal head and a platen roller to melt and transfer an ink in the ink tape 33 to the label tape 32, a conveying mechanism (not shown) which conveys the ink tape 33, and a conveyer mechanism (not shown) which conveys the label tape 32, and prints the printing data on the printing medium under the control of the print control unit 19. In this case, the printing unit 20 performs a three-time color superimposing printing operation on the label tape 32 with Y, M and C inks in the ink tape 33.

The print control unit 19 controls the printing unit 20 so as to print printing data fed from the controller 21 and includes a printing pattern memory 19*a* in which a printing (dot) pattern is to be spread.

As described above, the controller 21 may be composed of a microprocessor, and controls the operation of the whole printer, for example, the data inputting operation, printing operation, and displaying operation.

In FIG. 1, SW5 denotes a switch which detects the opening/closing of a cover 42 for the cartridge accommodating space 41. Reference numerals 22 and 23 denote an internal battery in the printer and a power supply for feeding predetermined drive voltages to the respective elements of the printer of FIG. 1.

Determination of the kind of the cartridge 31 (the color of a label tape 32 contained in the tape cartridge 31) by the cartridge detector 12 and the controller 21 will be described with reference to FIG. 4.

As described above, the printing unit 20 has the cartridge accommodating space 41 and the cover 42 which covers the space 41. The cover 42 has a transparent window 43 and is hinged on the printer body.

Figure 4:
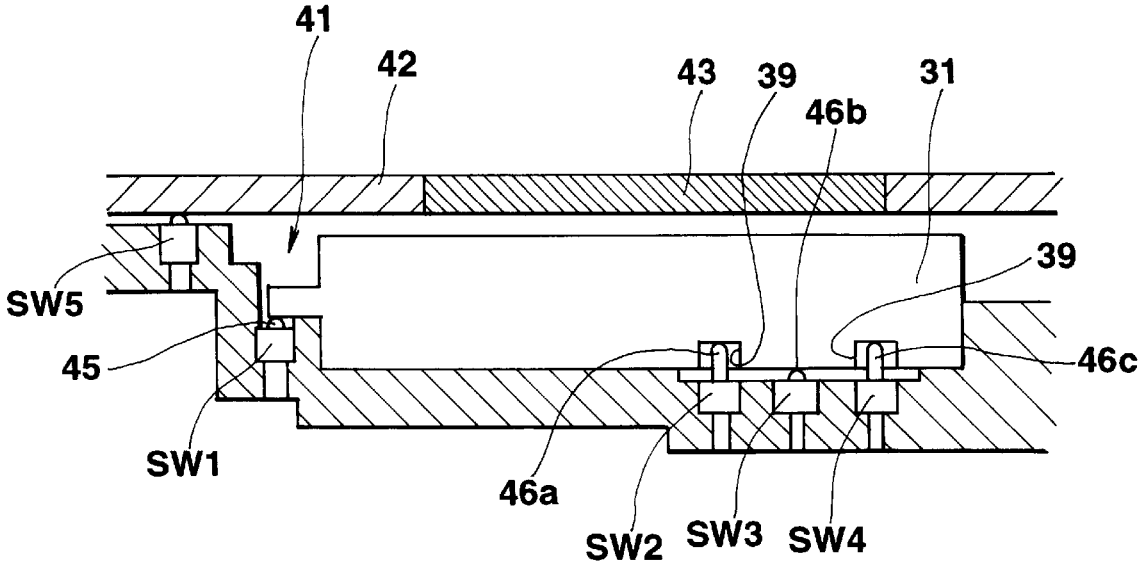
FIG. 4 shows a tape cartridge accommodated in the cartridge accommodating space in the printer body.

Four switches SW1–SW4 are provided within the cartridge accommodating space 41 and turned on/off depending on the presence/absence of a tape cartridge 31 set therein and its kind.

Where the tape cartridge 31 is set in the cartridge accommodating space 41 and the cover 42 is closed, as shown in FIG. 4, a movable element 45 of the switch SW1 is pressed and moved and thus the switch SW1 is on.

A maximum of three holes 39 are provided depending on the color of a label tape 32 contained in the cartridge 31 at positions corresponding to the switches SW2–SW4 on the outside of the tape cartridge 31. In this embodiment, the switches SW2–SW4 opposing the holes 39 on the tape cartridge are off because their movable elements 46*a*–46*c* are not pressed or moved. Without holes 39, the movable elements 46*a*–46*c* are pressed and moved by the tape cartridge 31 and thus corresponding switches are turned on.

In the embodiment, eight kinds of tape cartridges are discriminable, using the three switches SW2–SW4. In the tape cartridge 31 of FIG. 4, holes 39 are provided at positions corresponding to the switches SW2 and SW4 and no hole 39 is provided at a position corresponding to switch SW3. Thus, the movable element 46*b* of switch SW3 is pressed and moved and the switch SW3 is turned on whereas the movable elements 46*a* and 46*c* of the switches SW2–SW4 are not pressed or moved, so that the switches SW2 and SW4 are off. In FIG. 4, the switches SW1 and SW3 produce voltage outputs.

The output signals from the four switches SW1–SW4 are encoded by the encoder 13 and the resulting signal is output to the controller 21. In the embodiment of FIG. 4, a code signal "1010" is output from the encoder 13 to the controller 21.

Table 1 below shows the relationship between the presence/absence of a tape cartridge 31 in the cartridge accommodating space 41, kind of tape cartridge 31 and on/off states of switches SW1–SW4.

TABLE 1

| Label tape color/set or unset (tape cartridge) | SW1 | SW2 | SW3 | SW4 |
|---|---|---|---|---|
| white | 1 | 0 | 0 | 0 |
| orange | 1 | 0 | 0 | 1 |
| red | 1 | 0 | 1 | 0 |
| purple | 1 | 0 | 1 | 1 |
| black | 1 | 1 | 0 | 0 |
| blue | 1 | 1 | 0 | 1 |
| green | 1 | 1 | 1 | 0 |
| yellow | 1 | 1 | 1 | 1 |
| cartridge is unset | 0 | 0 | 0 | 0 |

In Table 1, "1" and "0" represent that the switch is on and off, respectively. Table 1 is contained in ROM 14.

The controller 21 determines the color of a label tape 32 contained in the tape cartridge 31 by comparing code data output from the encoder 13 and Table 1 contained in ROM 14.

Referring to Table 1, it will be seen that a red label tape 31 is contained in the tape cartridge 31 of FIG. 4.

As shown in FIG. 4, a switch SW5 is provided in the sidewall of the case to detect the opening/closing of the cover 42 for the cartridge accommodating space 41. When the cover 42 is closed/opened, the switch SW5 is turned on/off, respectively. Information on the opening/closing of the cover 42 detected by the switch SW5 is delivered to the controller 21, which controls the power supply 23 such that when the switch SW5 has detected the opening of the cover 42, the power supply 23 is not turned on in spite of the operation of the power supply key 11*a* whereas when the switch SW5 detects the opening of the cover 42 after the power supply 23 is turned on, supply of power to the respective elements of the printer is stopped.

Thus, for example, when the cover 42 for the cartridge accommodating space 41 is opened to replace the tape cartridge 31 during the time when the user is keying in printing data, supply of power to the respective elements of the printer is interrupted. In order for the user to restart the data inputting operation after the replacement of the tape cartridge 31, the user is required to close the cover 42, and again to operate the power supply key 12*a* to turn on the power supply.

A process for inputting printing data to the tape printer and then printing the input printing data will be described next with reference to FIG. 5.

First, the user operates the power supply key 12*a* of the key-in unit 11 to turn on the power supply 23 of the printer.

The controller 21 performs an initializing process in response to the turning on of the power supply (step S1) and receives a coded version of detection signals from the switches SW1–SW4 (step S2). The controller 21 determines the presence/absence of a tape cartridge 31 set and the color of its label tape 32, if any, from the received code signal by referring to Table 1 of ROM 14 (step S3).

When the controller 21 determines at step S3 that no tape cartridge 31 is set, it displays a message "Please set a tape cartridge" on the display 18 through the display control unit 17 (step S4).

Figure 6A:
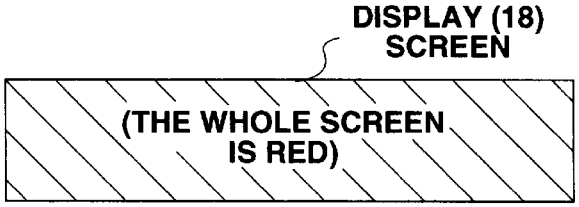
FIG. 6A illustrates the display of a screen occurring when the label tape is red.

When the controller 21 determines at step S3 that a tape cartridge 31 is set, it stores as information on the (background) color of the label tape 32 the coded signal received from the cartridge detector 12 into the background color data storage area 14*c* of the data storage 14 (step S5). Further, the controller 21 displays the color of the label tape 32 of the set tape cartridge 31 throughout the whole display screen of the display 18 through the display control unit 17 on the basis of the background color data (step S6). For example, when the set tape cartridge 31 has a red label tape 32, the whole display screen is displayed in red, as shown in FIG. 6A. This processing is achieved, for example, by writing the displayed color throughout the whole VRAM 17*a*.

In such display state, the controller 21 waits for incoming printing data such as character data which the user wants to print and data on its specified printing color from the key-in unit 11 (step S7).

The user operates the character keys 11*b* and a print color specifying key 11*c* to input printing data and their print color data, respectively.

When the controller 21 determines at step S7 that character data and print color data have been input, it stores the input character data and corresponding print color data in the form of code data into the printing data storage area 14*a* and print color data storage area 14*b*, respectively, of the data storage 14 (step S8). Alternatively, the respective colors of all or a part of the input character string data may be specified or their respective print colors may be specified later. Alternatively, once a print color is specified, this print color may be maintained for all character data which will be input thereafter until the next print color is specified newly.

Subsequently, the controller 21 controls the display control unit 17 to read from the font memory 16 pattern data for the character data stored in the printing data storage area 14*a* and spreads on the VRAM 17*a* the read pattern data in the colors specified with the print color data stored in the print color data storage area 14*b*. Thus, displayed on the display screen are the input characters in the specified colors in the background having the same color as the label tape 32. That is, the background of the display screen having the same color as the label tape 32 and the printing data having the specified colors are combined or synthesized and displayed (step S9).

Figure 6B:
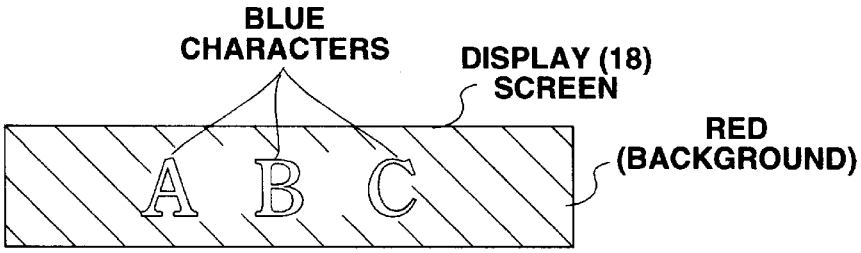
FIG. 6B shows an illustrative screen occurring when the label tape is red and the print color of input characters is blue.

For example, when a tape cartridge 31 which contains a red label tape 32 is set in the printer and a character string "ABC" is input as the printing data and its print color is specified as blue, a blue character string "ABC" is displayed in the red background as shown in FIG. 6B.

The controller 21 then determines whether the specified print color of the printing data is the same as the determined color of the label tape 32 (step S10) and further whether the specified print color of the printing data and the determined color of the label tape 32 belong to the same color system (step S11).

If so at step S10, the controller 21 displays a message "The same color. Please specify another color." on the display 18 through the display control unit 17 (step S12).

The controller 21 waits for the re-inputting operation of print color data from the key-in unit 11 by the user (step S13). If there is any re-input print color data, the controller 21 changes the print color data stored in the print color data area 14*b* of the data storage 14 (step S14). Control then returns to step S9, where the controller 21 changes the color of the printing data to the color of the re-input print color data and displays the printing data whose color has been changed in the same background color as the label tape 32 on the display screen.

If so at step S11, the controller 21 displays an alarm message "The same color system" along with a select screen "(1) The specified print color should be changed. (2) The specified color should not be changed." on the display 18 through the display control unit 17 (step S15). The determination about this same color system is achieved, for example, by comparing the background color of the label tape 32 and the print color data by referring to a related one of Tables in ROM 14, each Table containing colors of the same color system as a respective one of the colors of the label tapes 32.

Data on messages to be displayed at steps S4, S12, and S15 are contained in ROM 14.

When the controller 21 determines selection of a change of the specified print color and the re-inputting of the print color data by the user at step S16, the controller 21 changes the print color data stored in the print color data storage area 14*b* to the re-input print color data (step S17).

Control then returns to step S9, where the controller 21 changes the print color data of the printing data to that of the re-input print color data and then displays the printing data in the changed color in the background having the same color as the label tape 32 on the display screen of the display 18.

In the manner mentioned above, the processing at steps S7–S17 is iterated until the inputting operation of the character string data to be printed ends.

When the inputting operation of the character data ends and the input character data is to be printed, the user operates the printing key 11*d*, which is then detected by the controller 21 at step S18. The controller 21 reads printing data stored in the printing data storage area 14*a* and the print color data stored in the print color data storage area 14*b* and feeds them to the print control unit 19, which then reads font pattern data for the character data from the font memory 16 and sequentially spreads on the basis of the fed data the respective printing (dot) pattern data for yellow, magenta and cyan, which are the colors of inks in the ink tape 33, in the printing pattern memory 19*a* and controls the printing unit 20 to print the respective yellow, magenta, and cyan printing pattern data on the label tape 32 in a superimposing manner, using the ink tape 33 (step S19).

Figure 6C:
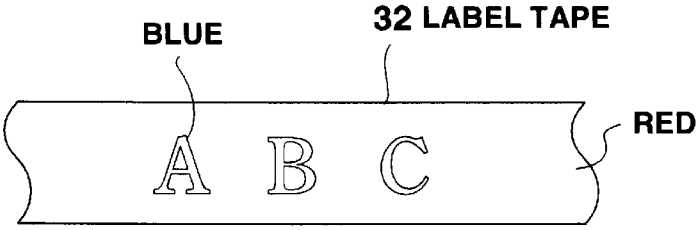
FIG. 6C illustrates a print obtained when the label tape is red and the print color of input characters is blue.

For example, when a tape cartridge 31 which contains a red label tape 32 is set in the printer and character string "ABC" data is input as printing data and its print color is specified as blue, a character string "ABC" is printed in blue on the red label tape 32, as shown in FIG. 6C.

When the tape cartridge 31 is replaced during the inputting operation of the printing data, the switch SW5 is turned off simultaneously with the opening of the cover 42. In this state, the controller 21 stops the supply of power from the power supply 23 to the respective elements concerned of the printer.

When a new tape cartridge 31 is set and the cover 42 is closed and then the power supply key 11*a* is operated, the controller 21 receives a code signal again from the cartridge detector 12 and determines the color of the label tape 32 contained in the new set tape cartridge 31.

Figure 5:
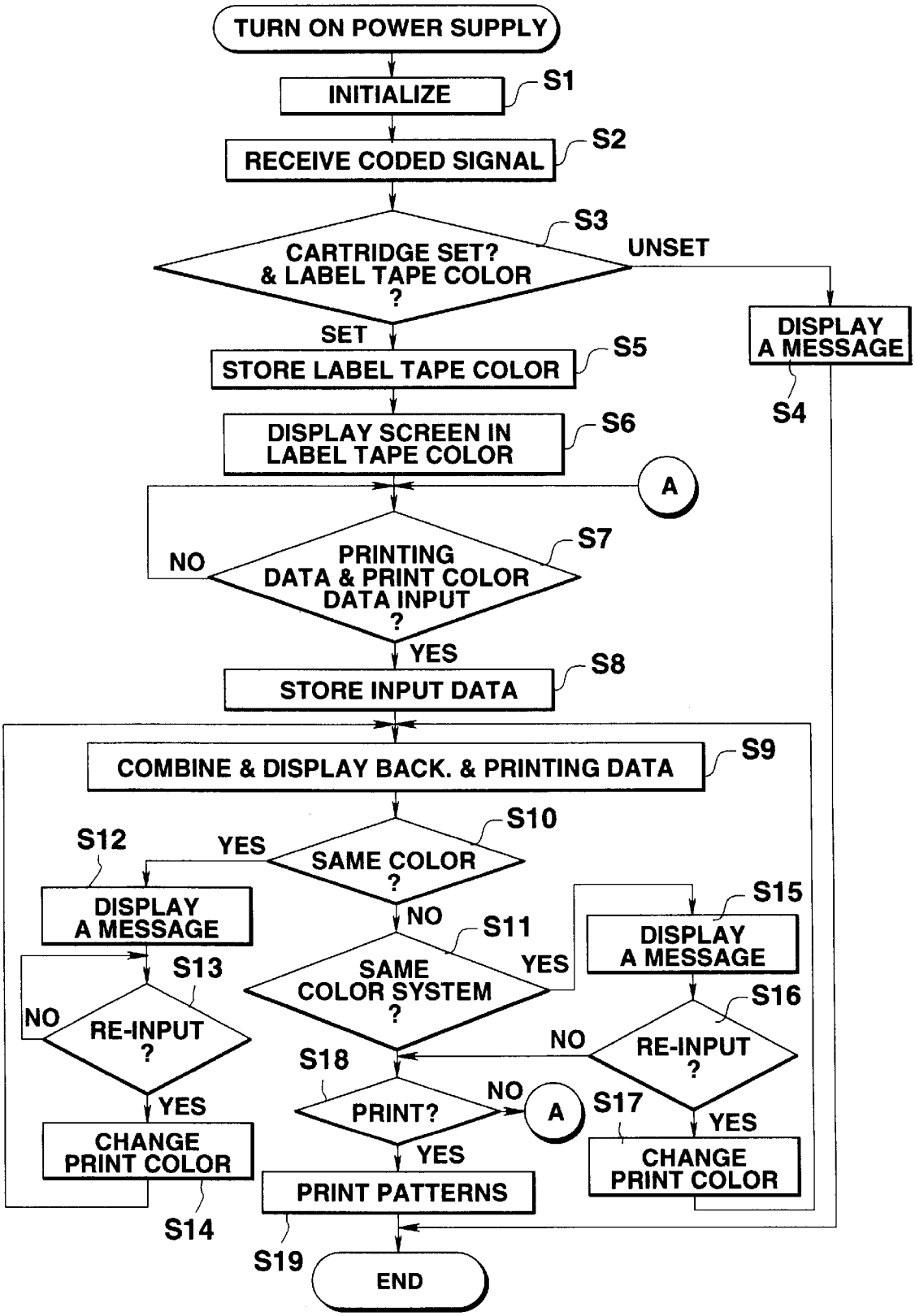

The controller 21 rewrites the background color data set in the background color data storage area 14*c* of the data storage 14 with the determined color data, controls the display control unit 17 to rewrite the background color data spread in the VRAM 17*a* with the determined color data, and then returns to its regular processing of FIG. 5.

As described above, according to the tape printer, the background of the display screen is displayed in the color of the label tape 32 contained in the tape cartridge 31 set in the tape printer. Thus, the user can immediately recognize the color of the label tape 32 contained in the tape cartridge 31 set in the tape printer. Since the printing data is displayed in the specified (print) color, the user can input the printing data while considering the layout of colors. Thus, there is no need for correcting the input data in accordance with the result of the printing.

While in the above description the user herself specifies a print color of the printing data, the print color of the printing data may be set automatically depending on the color of the label tape 32, for example, by referring to Table 2 below contained in ROM 14.

TABLE 2

| Label tape color | print color of printing data |
|---|---|
| white | black |
| orange | blue |
| red | green |
| purple | yellow |
| black | white |
| blue | orange |
| green | red |
| yellow | purple |

Table 2 contains colors of label tapes and print colors of printing data opposing the colors of label tapes in corresponding relationship. For example, when the controller 21 determines on the basis of the result of the detection of the cartridge detector 12 that the color of the label tape 32 is white, the controller 21 automatically sets black opposing white as the print color of the printing data by referring to Table 2. Similarly, when the controller 21 determines that the color of the label tape 32 is green, the controller automatically sets red as the print color of the printing data.

Figure 7:
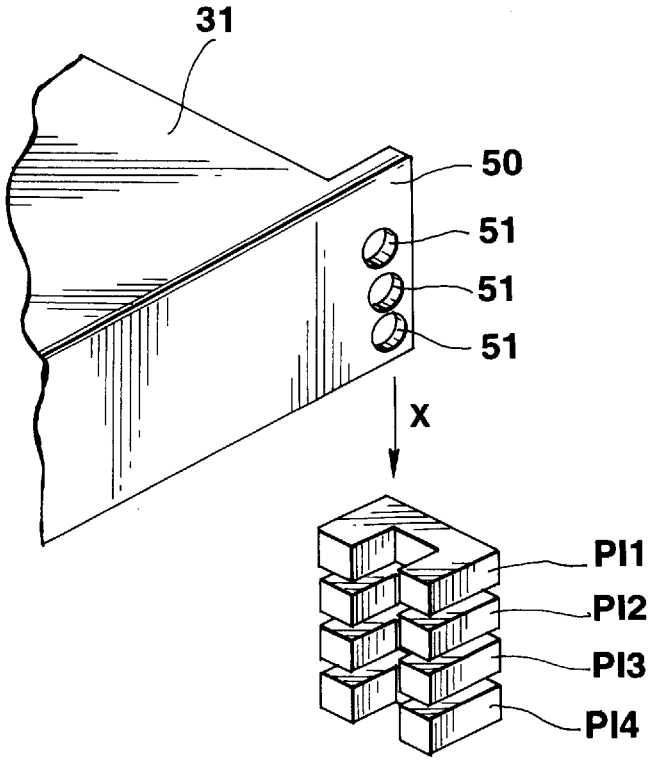
FIG. 7 shows another embodiment which detects the kind of a tape cartridge.

While several switches have been used as composing the cartridge detector 12 of the embodiment, they may be replaced with photointerrupters. In FIG. 7, reference symbols PI1–PI4 denote four photointerrupters provided in the cartridge accommodating space 41 in the printer 20. The tape cartridge 31 is inserted into the accommodating space 41 in the direction of arrow X such that an extension 50 of a cartridge side enters the inside of four U-like piled photointerrupters PI1–PI4 with the extension 50 having a maximum of three through holes 51 which are alignable with the corresponding light emitters and receivers of photointerrupters PI2–PI4. The extension 50 is inserted between the light emitters and corresponding receivers of the photointerrupters PI1–PI4. Thus, if there is a hole 51 between the corresponding light emitter and receiver, light from that light emitter is received by the corresponding light receiver. If otherwise, light from that light emitter is interrupted. Detected voltages from the photointerrupters PI1–PI4 are output to the encoder 13 which encodes the detected voltages and outputs the resulting coded signal to the controller 21, which determines the color of the label tape 32 by comparing the coded signal from the encoder 13 and Table 3 below.

TABLE 3

| Label tape color/set or unset (tape cartridge) | PI1 | PI2 | PI3 | PI4 |
|---|---|---|---|---|
| white | 0 | 0 | 0 | 0 |
| orange | 0 | 0 | 0 | 1 |

TABLE 3-continued

| Label tape color/set or unset (tape cartridge) | PI1 | PI2 | PI3 | PI4 |
|---|---|---|---|---|
| red | 0 | 0 | 1 | 0 |
| purple | 0 | 0 | 1 | 1 |
| black | 0 | 1 | 0 | 0 |
| blue | 0 | 1 | 0 | 1 |
| green | 0 | 1 | 1 | 0 |
| yellow | 0 | 1 | 1 | 1 |
| cartridge is unset | 1 | 1 | 1 | 1 |

In Table 3, data "1" and "0" represents that the light receiver of a photointerrupter concerned has a significant output and no significant one, respectively. Table 3 is contained in ROM 15. As described above, the three holes 51 are provided which are alignable with the photointerrupters PI2–PI4 in the extension 50 of the cartridge 31 of FIG. 7 and there is no hole which is alignable with the photointerrupter PI1. Thus, when the tape cartridge 31 is inserted into the cartridge accommodating space 41, the cartridge detector 12 (encoder 13) outputs a coded signal "0111", which indicates that a yellow label tape is accommodated, by referring to Table 3.

While in the above description the label tape 32 is illustrated as having any one of eight colors; white, orange, red, purple, black, blue, green and yellow, any other color may be used: for example, transparent, silver, gold, pink and any of their fluorescent colors.

While the background color of the display screen is illustrated as being displayed simultaneously with the time when the power supply is turned on and the tape cartridge 31 is released and set, the background color may be displayed, for example, only when a layout display mode for the display, etc., of the printing image is set.

While in the above description the present invention has been illustrated, using a printer which prints data on the label tape 32 as an example, the inventive printer is not limited to this particular case. For example, the present invention is applicable to printers which print any data on any printing medium, for example, word processors, personal computers connected to printers, etc.

The determination of the color of a printing medium is not limited to the utilization of the turning on/off of switches, but may be performed by color sensors disposed adjacent to a printing medium.

What is claimed is:

1. A printer comprising:

a cartridge accommodating unit for exchangeably accommodating therein any one of a plurality of different cartridges, each cartridge containing a label tape as a printing medium and a color printing ink tape which contains a plurality of different color inks, and each cartridge having a shape which varies depending on a color of the label tape;

a detection unit for detecting the shape of a given one of plurality of different cartridges which is accommodated in said cartridge accommodating unit;

a determining unit determining the color of the label tape contained in the cartridge accommodated in said accommodating unit based on the detected shape of the cartridge detected by said detection unit;

an input unit for inputting printing data including at least one of character and symbol data, and for inputting print color data which specifies a print color of the printing data;

a data storage unit for storing the printing data and the print color data input by said input unit;

a display unit having a color display screen;

a display control unit causing the color display screen of the display unit to display a background of the printing data in the color of the label tape determined by said determining unit, and to display on the background the printing data stored in said data storage unit in the color specified by the print color data stored in said data storage unit; and a printing unit for printing the printing data stored in said data storage unit on the label tape contained in the cartridge accommodated in said cartridge accommodating unit using the ink tape contained in the cartridge, said printing data being printed in the print color specified by the print color data stored in said data storage unit.

2. A printer according to claim 1, further comprising:

a first determining unit: for determining whether or not the print color of the printing data specified by the print color data stored in said data storage unit coincides with the color of the label tape determined by said determining unit; and a control unit, responsive to said first determining unit determining that the print color of the printing data specified by the print color data stored in said data storage unit coincides with the color of the label tape determined by said determining unit, for preventing said printing unit from printing the printing data stored in said data storage unit.

3. A printer according to claim 2, further comprising:

a first message display control unit, responsive to said first determining unit determining that the print color of the printing data specified by the print color data stored in said data storage unit coincides with the color of the label tape determined by said determining unit, for causing said display unit to display at least one of a first message indicating such coincidence, and a second message which urges a user to reinput the print color data;

a first data changing unit, responsive to the user reinputting the print color data in accordance with one of the first and second messages, for changing the print color data stored in said data storage unit to the reinputted print color data, wherein said first determining unit then determines whether or not the print color of the printing data specified by the reinputted print color data coincides with the color of the label tape determined by said determining unit, and wherein said control unit continues to prevent said printing unit from printing the printing data stored in said data storage unit if said first determining unit determines that the print color of the printing data specified by the reinputted print color data coincides with the color of the label tape determined by said determining unit.

4. A printer according to claim 1, further comprising;

a color information storage unit which contains information with respect to a plurality of colors belonging to a same color system;

a second determining unit for determining, based on the information stored in said color information storage unit, whether or not the print color of the printing data specified by the print color data stored in said data storage unit and the color of the label tape determined by said determining unit belong to the same color system;

a second message display control unit, responsive to said second determining unit determining that the print color of the printing data specified by the print color data stored in said data storage unit and the color of the label tape determined by said determining unit belong to the same color system, for causing said display unit to displaying at least one of a third message indicating such coincidence, and a fourth message indicating that the print color data is reinputtable; and a second data changing unit, responsive to the user reinputting the print color data in accordance with one of the third and fourth messages, for changing the print color data stored in said data storage unit to the reinputted print color data, wherein said second determining unit then determines whether the print color of the printing data specified by the reinputted print color data coincides with the color of the label tape determined by said determining unit.

5. A printer according to claim 1, wherein said detection unit comprises a plurality of switch units which are selectively actuated depending on the shape of the given one of said plurality of different cartridges which is set in said cartridge accommodating unit.

6. A printer according to claim 1, wherein said detection unit comprises a plurality of photodetectors for cooperatively detecting the shape of the given one of said plurality of different cartridges which is set in said cartridge accommodating unit.

* * * * *